United States Patent [19]

Terry, Jr. et al.

[11] 4,322,081

[45] Mar. 30, 1982

[54] FINGER TIP GOLF GAME

[76] Inventors: Wilfred F. Terry, Jr.; Marie K. Terry, both of Apt. 203, 90 Padonia Rd., Lutherville, Md. 21093

[21] Appl. No.: 251,102

[22] Filed: Apr. 6, 1981

[51] Int. Cl.[3] ..... A63F 7/06

[52] U.S. Cl. ..... 273/87.4

[58] Field of Search ..... 273/87.4, 87.2

[56] References Cited

U.S. PATENT DOCUMENTS

| | | | |
|---|---|---|---|
| 731,825 | 6/1903 | Voorhees | 273/87.4 |
| 1,636,042 | 7/1927 | Buckberg | 273/87.4 |
| 1,820,618 | 8/1931 | Houzenga | 273/87.4 |
| 3,054,615 | 9/1962 | Budish | 273/87.4 |
| 3,503,613 | 3/1970 | Caya | 273/87.4 |

FOREIGN PATENT DOCUMENTS

| | | | |
|---|---|---|---|
| 187101 | 10/1922 | United Kingdom | 273/87.4 |
| 1479446 | 7/1977 | United Kingdom | 273/87.4 |

*Primary Examiner*—George J. Marlo

[57] ABSTRACT

A scaled-down golf game has a plurality of golfers with respective clubs pivotally mounted to the player bodies; each club has an actuator at the rear of the golfer; an integral length of wire forms the clubs and actuator; the wire is folded over itself and may be refolded, to form a club head of desired weight and shape, and extends upwardly as a shank for the club, then through pivotal mounting formed by a bore through the body and from the point of emergence at the rear angled in a vertical plane to form an actuator for the club; the players preferably have different clubs and actions so that to change clubs a player does not have to assemble any thing but may simply use a different golfer; different actions are provided by counterbalancing and/or through quick-change resilient bias; complete equipment in the form of tees, water hazards, traps, greens, flags and balls is provided.

1 Claim, 6 Drawing Figures

FINGER TIP GOLF GAME

FIELD OF THE INVENTION

This invention relates generally to games and particularly to a golf game which can be played on a small scale indoors on a table top or on a rug.

BACKGROUND OF THE INVENTION

One of the present inventors has played golf for more than fifty years and has always had a great love for the game but unfortunately has had to give up the game due to age and poor health. Knowing the time was coming when he would not be able to continue playing the outdoor game of regular golf he decided to figure out a way to continue the game indoors on a small scale and still be able to derive a great deal of pleasure with same.

In the early 1920's when he first started to play golf, clubs were known as woods and irons as they still are today but they also had names; today they have numbers instead of names, except for the putter, which retains its name, each wood having a different angle of loft to the club head and likewise each iron. A player selects the club to use depending on the distance and obstacles he may be faced with from where his ball lies, to the green. An iron such as a pitching wedge has a great deal of loft to the face of the club, which produces a back spin on the ball that will enable the golfer to control the distance the ball will travel after it hits on the surface of the green. These general principles apply to the present game, but because of the fact that this is a miniature golf game and that space may be limited, it is only necessary to have three clubs, a driver, a chipping or pitching club and a putter. Each of these three clubs is incorporated in a separate small golfing figure and is used by all the people playing the game. The person whose ball is farthest from the green shoots first and when all the balls are on the green, the same rule applies. The ball farthest from the hole putts first; if another ball is in his way, it can be moved, allowing him to putt safely. The ball that moved is then put back to where it was and played in turn. Following this pattern, 2, 3 or 4 players could play without having any additional golfing figures or clubs.

In professional golf the golfers will quite often go to the driving range and practice shots for an hour or so before play in a tournament. This would also apply to the little golfers. The players can set up a small green about 10 feet away and test drive the styrofoam balls to get used to how far you have to stretch the rubber band to propel the ball the desired distance. All shots are made by the use of the forefingers of each hand. One finger pressing down on the golfers head to hold same in line with green and the other forefinger to raise the actuator to the necessary height to propel the ball the right distance.

FIRST OBJECTS OF THE INVENTION

Accordingly, first objects of this invention are to provide a system for playing golf on a small scale, indoors at any time and which is satisfying and true to the game, and provides uniform results, regarding skill and practice.

PRIOR ART

In the prior art various disclosures relating to small scale golf games and apparatus for same have been made including those in the following U.S. Pat. Nos.:

731,825, G. T. Voorhees, 6-23-03, disclosed a golfer figure operable by pulling a string against the bias of a spring which, on release to the string pivoted a club, driving a ball;

1,636,042, F. E. Buckberg, 7-19-27, disclosed a golfer figure with a club pivotable about an axis through the body defined by an extension of the wire club shaft which then turned down behind, providing a handle for actuating the club;

3,045,615 granted to B. O. Budish, 9-18-62, disclosed a layout of part of a golf course; the golfer figure had a resilient midsection so as to drive the ball by spring-back action of the upper part when twisted and released;

3,503,613 granted to S. E. Caya, 3-31-70, disclosed a spring-return flexible cable actuated pivotally mounted club held by a golfer figure; a ring-shaped "hole" was provided.

However, it is believed that these prior art disclosures fall short of the advantages of the present invention according to the objects set forth above and as follows.

FURTHER OBJECTS OF THE INVENTION

Further objects are to provide a system as described which is extremely economical to make and to purchase, which can be used on small (tabletop) set-ups or on large set-ups and which permits the player easily to vary the force with which the clubs strike the balls; to provide means for changing clubhead angle and address of the ball relative to the simulated user's stance; to provide realistic scale model tees, traps, waterholes and greens at very little expense and to provide a system in which these can be arranged as desired to simulate real golf links; to provide for very delicate putting adjustments, and to provide colorful, handsome and attractive apparatus as disclosed, which can last indefinitely regardless of hard play.

Still further objects are to provide a system as described which can be used to teach young children the rules and customs of the game, and which is enjoyable for people of almost all ages and physical conditions to play and to observe in play.

Yet further objects are to provide a system as described in which certain of the "golfers" provided can be manipulated to address and strike the ball under different actuation; in which a variety of clubs and club actions are provided in an identical set of golfer bodies, so that selection of a club may be made without detachment or attachment, merely by selecting a golfer, and which is safe and easy to play in the different shots required.

BRIEF SUMMARY OF THE INVENTION

In brief summary given as cursive description only and not as limitation, the invention includes a complete simulated golf game with "golfers" having clubs actuable in plural adjustable modes.

DETAILED DESCRIPTION OF THE FIGURES

Figure 1:
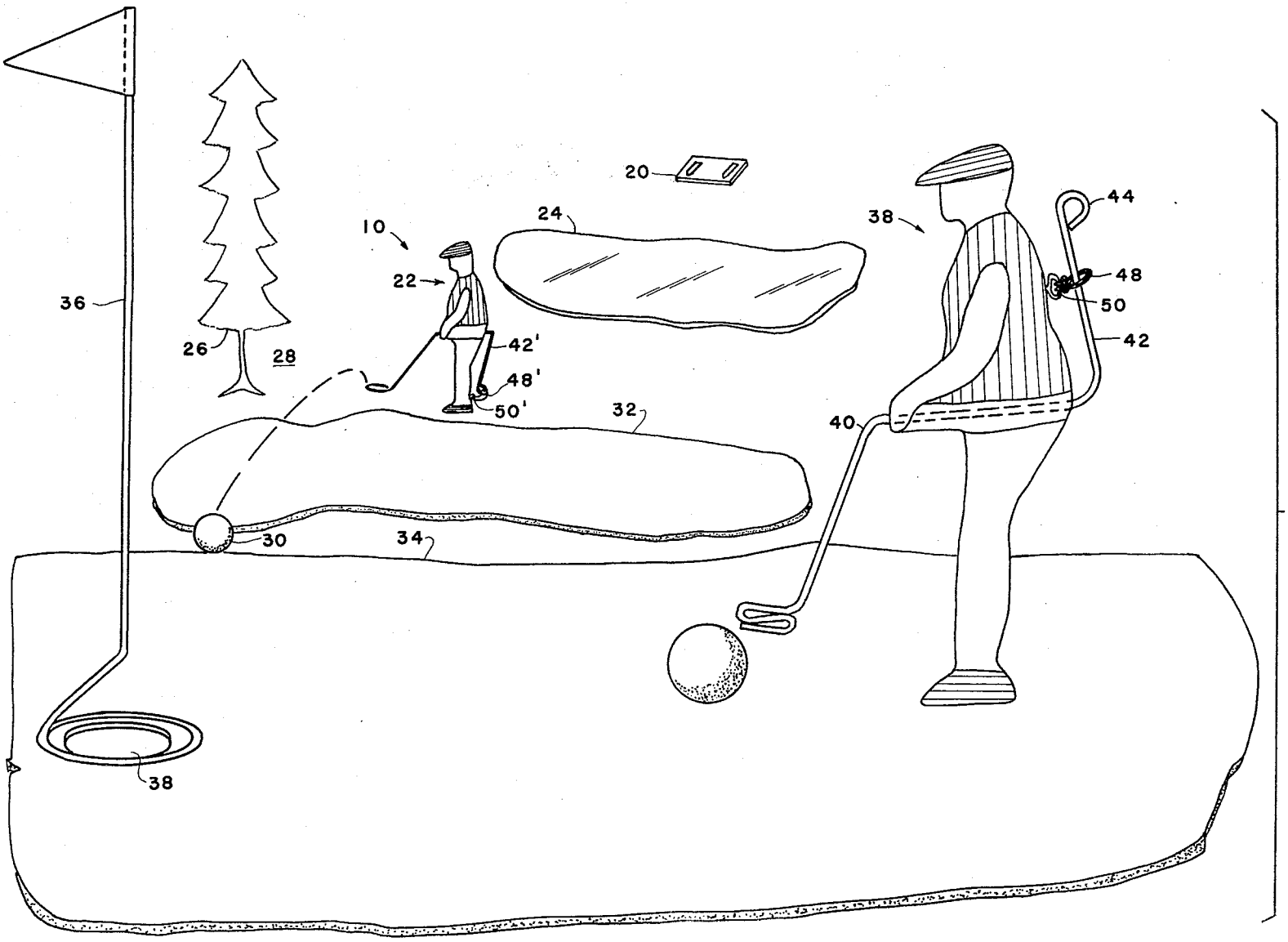
FIG. 1 is a fragmentary perspective view of a golfing system according to this invention, illustrating a simple layout with two golfers in play.

FIG. 1 shows the invention 10 in representative-element assembly. From a tee 20 in the distance a first golfer 22 has driven a ball over a water hazard 24 and now is making his approach shot from alongside a tree 26 on the fairway 28. The ball 30 has cleared sandtrap 32 which guards the approach and will land on the green 34 in line with the flag 36 and hole 38.

On the green a second golfer 38 is preparing to putt the ball into the hole after the flag is removed.

In accordance with an important provision of the invention, the golfers may advantageously be of the same construction whereas clubs and actions may be variously different, although all golfers have a unitary wire forming a clubhead, shank and axle passing through the body, and, energizing at the rear, a crank or actuator. Depending on the size of the course layout, which may be varied at the option of the user, employing further tees, greens, flags, sandtraps, water hazards, trees and players provided, and depending on the rolling resistance of the fairway (which may be a rug in the house for example) or a table cover, or a pool table, or table tennis table), the shots required may be made with or without assistance of resilient bias provided for more forceful swing in some golfers.

The balls 30 are of relatively large diameter "Styrofoam" and respond in good proportion when struck.

The second golfer 38 has for the greater precision always needed in putting, two important provisions:

(a) the club-forming wire 40 emerges as an actuator 42 at the rear of the golfer in an upward direction which may be generally in-plane with the club shank and head, and which preferably has a combination counter-balance and handle loop 44 at the end;

(b) the actuator goes upwardly to the level of the golfer's head, from which head it is spaced about one diameter, preferably.

Below the upper end of the second actuator a rubber band 48 is looped around the actuator and attaches to a screw eye 50 in the golfer's back.

These two provisions permit the player to look down directly on the golfer while aligning the golfer, then holding down on the golfer's head to maintain alignment, and simultaneously pivoting the actuator forwardly with another finger, stretching the rubber band, and releasing the actuator for a smooth, easy pendulous swing, accurately directed and with proper force.

The relatively large diameter of the "Styrofoam" balls permits them to roll true.

A different, resiliently biased golfer actuator arrangement appears in the first golfer 22. The club head, shank, axle and body portions are the same as in the second golfer 38, but the actuator 42' is down turned, generally forming a "U"-shape of the wire as a whole, and a rubber band 48' connects a screw-eye 50' in the back of the golfer's legs with the actuator, which has a folded-back terminus to clamp the rubber band to the actuator.

To cause the club to swing, the golfer may be held in alignment with one of the player's fingers on top of the head and the other hand pivoting the actuator rearwardly against the rubber band bias and releasing it to drive the ball, or for long fairway shots, and for approaches. The different directions of actuation lend variety to the game.

Great economy of manufacture is apparent in the two-piece construction of the parallel-sided jig-sawable golfers with the wire held in the journalled relation to the body by the two bends respectively at the front and back of the body and by the other features formed of the integral piece of wire.

Figure 2:
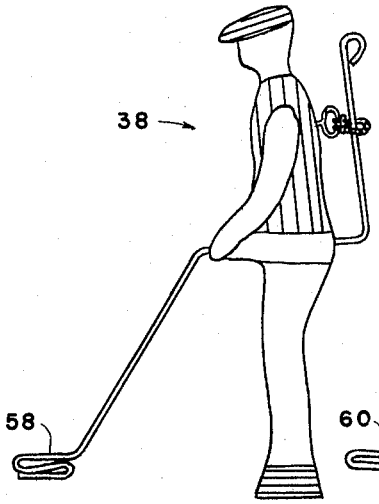
FIG. 2 is a side elevation-view of a golfer in a further embodiment.

FIG. 2 shows a golfer-embodiment 38 in a view showing contrast of actuation and of club 58, a putter, with the other golfers in the succeeding Figures. The putter is formed by an outward and downward "S" configuration continuous with the shank of the club.

Figure 3:
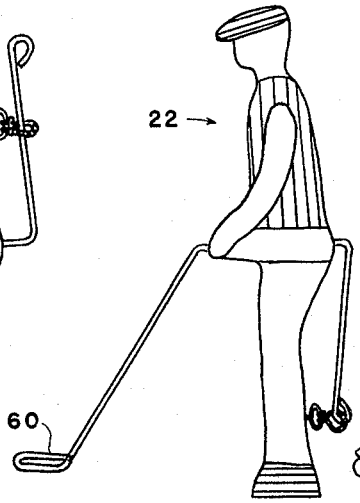
FIG. 3 is a further side elevation-view of a golfer.

FIG. 3 shows a golfer 22 with a lofted iron 60 for chipping or pitching; the iron is a single outward and upward and return loop of wire, also integral with the shank.

Figure 4:
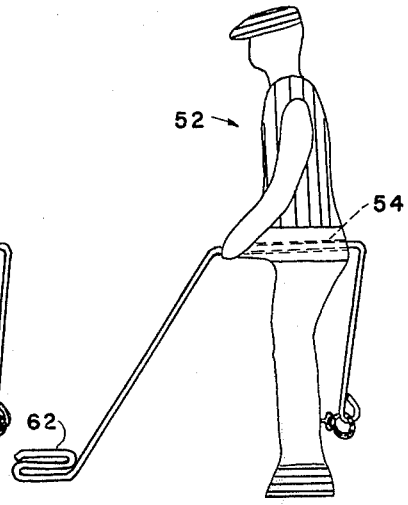
FIG. 4 is yet a further side elevation-view of a golfer.

FIG. 4 shows a golfer 52 with a driver 62, formed in "S" shape, outward and upward from connection with the shank. The "S" configurations give a 50% greater club head weight.

An advantage appears in all the golfer-embodiments, in that the bias can be quickly and easily changed, at almost no cost, by slipping the rubber bands off the screw eyes and actuators, and substituting rubber bands of different length and/or weight. Advantageously, the rubber bands in any case may be slack at the rest position, producing a more natural swing.

Another advantage of all embodiments is that they can be played as right-handed golfers or as left-handed golfers, the bore 54 through the wooden or plastic body being the same in all cases, symmetrically level and square, and that the "loft" or attack angle of the club face can be changed by simply bending the soft-iron wire to suit. Similarly, the clubs can be angled for slice or hook.

Figure 5:
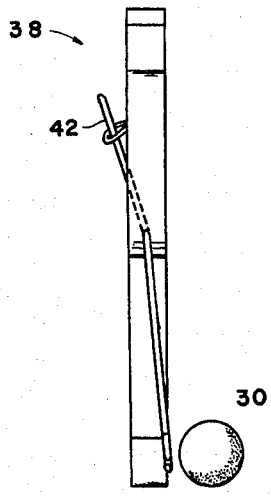
FIG. 5 is a front elevation-view of a golfer.

FIG. 5 indicates another feature: the address to the ball 30 of the golfer (38 shown) can be changed, as by bending the actuator 42 out-of-plane with the club shank in the desired direction to cause the club head pivotal rest position to advance or to retreat from the vertical relative to the golfer's body. This may be done in any embodiment.

Figure 6:
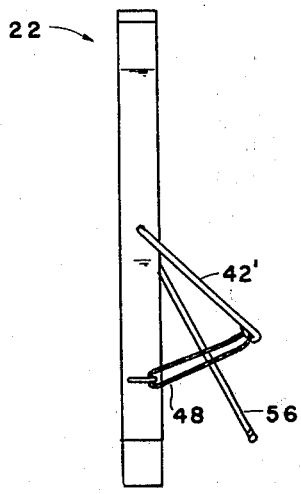
FIG. 6 is a rear elevation-view of a golfer.

FIG. 6 is a similar but rear view of golfer 22 showing such a bent-out-of-place aspect of the club shank 56 relative to the actuator 42', made readily visible by illustrating the actuator and club partially drawn back against the bias of rubber band 48, as in preparation for a shot. In this embodiment there is clearance for a first hand of the user to grip the upper body of the golfers while with the second hand he manipulates the actuator, spaced below.

The club heads are easily formed by folding the wire outward from the shank and back and, if desired, outward again. The wire may be bent at any time.

Thus the very important and convenient feature of selecting clubs by substituting golfers instead of having to substitute clubs in the golfers hands or otherwise attached to the golfers is easily and economically achieved.

Materials for the invention are conventional and economical. Size is adaptable to various embodiments; in a preferred embodiment the golfers are 6 inches (15 cm) high, 9/10 inch (1.5 cm) thick, the feet are 1 inch (2.5 cm) long; the bore for the axle is $3\frac{1}{4}$ inches (8.5 cm) up from the bottom by 2 inch (5 cm) long and slightly greater in diameter than the wire diameter of 3/32 inch (2.5 mm). Shape is such as to balance on the feet, the club head being about 1 inch long and the heel of the club being about 2 inches (5 cm) from the toe of the golfers. One to two inch diameter rubber bands of 1/32 inch (0.9 mm) to 3/32 inch average cross-sectional diameter have been found effective. The greens and sand traps may be made of 3/32 inch thick polyurethane foam, a flexible material that clings readily to almost any surface and offers secure footing for manipulation of the golfers, and good grain for rolling the balls, and may be colored green and tan respectively. Area may be in proportion to golfer size.

The water hazards may be thin reflective plastic sheeting. The balls may be 1 inch (2.5 cm) in diameter.

The flagpoles may be of the same wire as the wire used for the golfer assemblies; preferably each flagpole rises from the center of a respective ring to the rim of which it connects integrally through a 45° inclined portion, providing stability and clearance. The pennants may be clamped by a downturned terminum on each flagpole. The trees may be conventional plastic trees such as are used for toy landscapes.

As indicated, the balls may be about 1/6 the height of the golfers. It will be appreciated that a complete fairway can be made of a roll of polyurethane foam sheet and the apparatus described fitted on it.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a golf game with simulated golfers having human characteristics, golf balls, and golf course features, the improvement comprising: a golfer including a body having front and back, a wire having an axle pivotally journalled in a bore in the body, means retaining the wire in said journal comprising: an integral actuator leading at a first angle in a vertical plane from the axle behind and an integral shank leading downward at a second angle from the axle in front; a portion of the wire in the shape of a clubhead integrally forming a club with said shank; means permitting a user with one finger to hold said golfer in alignment and simultaneously to manipulate the respective said integral actuator to strike a golf ball, comprising said integral actuator leading upwardly at said first angle to a terminus at the level of the head of said golfer; resilient biasing means above said axle connecting said integral actuator with said golfer's body; means for quickly and economically replacing the resiliently biasing means to change said bias, comprising the resilient biasing means being a rubber band, means detachably affixing the rubber band to said golfer's body and to said integral actuator; and means counter-balancing said club for smoothing the swing thereof, comprising a loop on said terminus at the level of the head of said golfer.

* * * * *